United States Patent [19]

Strathmann

[11] Patent Number: 4,664,011

[45] Date of Patent: May 12, 1987

[54] FLUTE

[76] Inventor: Arnfred R. Strathmann, Dorfstrasse 31, 2300 Melsdorf/Kiel, Fed. Rep. of Germany

[21] Appl. No.: 661,785

[22] Filed: Oct. 16, 1984

[30] Foreign Application Priority Data

Oct. 17, 1983 [DE] Fed. Rep. of Germany ..... 3337704

[51] Int. Cl.[4] ..... G10D 7/02

[52] U.S. Cl. ..... 84/384

[58] Field of Search ..... 84/384, 385 R, 380 C, 84/382

[56] References Cited

U.S. PATENT DOCUMENTS

| | | | |
|---|---|---|---|
| 94,795 | 9/1869 | Wardoum | 84/384 |
| 307,807 | 11/1884 | Schaeffer | 84/384 |
| 901,913 | 10/1908 | Julliot | 84/384 |
| 1,211,983 | 1/1917 | Sternberg | 84/384 |
| 1,643,463 | 9/1927 | McAvoy | 84/384 |
| 2,330,379 | 9/1943 | Powell | 84/384 |
| 3,888,154 | 6/1975 | Wesley, Sr. | 84/384 |

*Primary Examiner*—Benjamin R. Fuller

[57] ABSTRACT

A flute is described having the mouthpiece, the shape and the dimensions of a recorder but is however provided with a key mechanism similar to that of a saxophone. The buttons, keys and tone holes are however adapted to the special features of sound generation by a recorder.

14 Claims, 4 Drawing Figures

FLUTE

Figure 1:
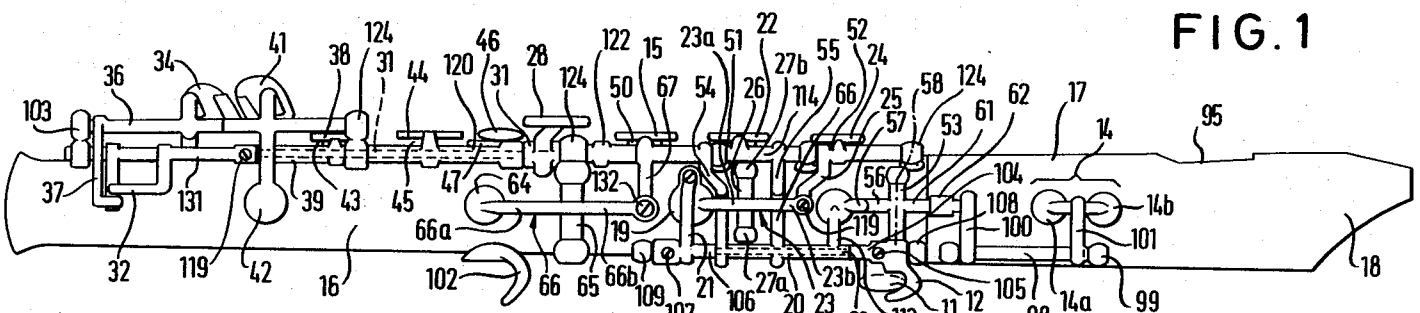

The invention relates to a flute having the mouthpiece, the shape and the dimensions of a recorder, wherein the tone holes are closable by keys operated via button operated levers.

Although the recorder is the most widespread musical instrument it has hardly been further developed since its creation. The recorder has only tone holes which are mainly covered by the player's fingers. In this way it is indeed possible to play tone scales however the semi-tones which lie between the full tones can only be played with difficult fingering which in no way corresponds to an ideal fingering system. Flutes which are in part provided with double holes do not provide a convincing solution to the problem. The holes which lie directly alongside one another must namely be covered over by a single finger either individually or together depending on the requirements and this presents a considerable degree of difficulty.

The player of a recorder thus rapidly reaches limitations if he wishes to have full technical command of the instrument and to play in all keys. This is made more difficult by the fact that some tone holes should only be opened to form a narrow slot in order to be able to play higher tones or notes. The rendering of these tones of the upper octaves, approximately above $g^2$ is nevertheless poor and most players are not able to make music in this range.

The recorder has therefore remained a relatively simple instrument up to the present time. It is indeed suitable for the playing of simple pieces and also for beginners but is unsuitable for the playing of high quality music and thus is hardly used at all in orchestras.

There are indeed flutes (Boehm flutes) which consist of metal, for example German silver, and which have a key and lever system which can be regarded as refined. The key system is however so constructed that it places considerable demands on the musician. Moreover, the production of tones is not simple so that this instrument remains the preserve of musicians who are really specialists.

The principal object underlying the present invention is to provide a flute which has the tone production and the sound of a recorder, which is however provided with a logically constructed fingering system which is simple to play and which also makes it possible to blow semi-tones and the higher and highest notes exactly and with troublefree rendering.

In order to satisfy this object the invention envisages that there are provided one after the other starting from the end remote from the mouthpiece, on the upper side, a C-button, a D-sharp button, a D-button, an E-button, an F-button, a G-button, an A-button and an H-button and, on the lower side, an octave key button, and also keys connected to the buttons and tone holes associated with the buttons in saxophone arrangement.

The saxophone fingering system is particularly logically constructed and thus relatively easy to play because the sequential basic tones can be played one after the other with the sequential fingers of the hand starting from the little finger of the right hand and going up to the index finger of the left hand. At the same time the flute of the invention does not have the relevant problem encountered with the saxophone of producing sound by means of a wooden reed for which a player requires special teaching simply in order to blow a pure note.

The particular advantage of the flute of the invention lies in the fact that a saxophonist for example can at once play the new flute whereas he would first have to laboriously learn to play a normal flute; a normal recorder would however never be entertained in an orchestra as a second instrument to a saxophone. On the other side of the coin a person who has learned to play the flute of the invention can also easily learn to play a saxophone because the fingering system is substantially the same and it is only necessary to learn the different way of producing the note.

By means of the flute of the invention it is possible to play all notes from low H up to high F including all semi-tones.

The instrument is not only suitable for musicians and orchestras but also for beginners because beginners, do not have any difficulties with the new flute when producing sound and the actuation of the fingering system can be quickly learned.

The flute of the invention is preferably so constructed that it consists of an elongate and preferably straight body of tubular shape, and of a preferably straight throat in one piece with the mouthpiece which can be plugged together with the straight body, wherein the material for the body and the throat with mouthpiece is preferably caoutchouc, metal or wood. The body and mouthpiece are thus basically constructed like a recorder.

Even though the basic construction of the fingering system of the flute of the invention corresponds to that of the saxophone it is nevertheless expedient for certain modifications and additions to be made in relation to the saxophone fingering system in order to provide an instrument which can be played in an ideal manner and which allows an exact rendering of all tones including the semi-tones.

Thus a first advantageous development of the invention envisages that the octave key button is arranged directly above a support projection provided for the left thumb on the lower side of the flute, with the octave key button acting via a first rocker lever on two octave keys which are arranged spaced apart above one another and which are simultaneously so connected via a G-octave key lever with the G-button that when the octave key button and the G-button are depressed only the lower octave key arranged on the body is in the open position and that when the G-button is not depressed only the octave key arranged on the throat is in the open position. The A-button is preferably also connected with the octave keys via a corresponding octave lever in such a way that when the G-button is depressed but not the A-button the lower octave key on the body is closed but the upper octave key is open. In this way one obtains the advantage that a few very comfortable fingering positions are available as alternatives for high C-sharp, D, D-sharp, E and F which results in excellent sound purity and rendering.

Furthermore, it is of particular advantage if the upper octave key consists of two individual caps which each cooperate with a respective hole in the throat and which are arranged at a small distance above one another and jointly actuated. The upper octave key is thus constructed, in accordance with the invention, as a double-key which results in easy rendering of some notes, preferably from $a^2$. The double-key stabilises the notes A, A-sharp, H, C, C-sharp, D, D-sharp and E, F.

A single larger bore in place of these two smaller bores which are provided one above the other at a small distance would not result in this advantageous effect. It is only the arrangement, in accordance with the invention, of the two small octave bores and the associated octave caps one above the other at a small distance which stabilises the high frequency oscillations so that one can speak of easy rendering.

A further embodiment is characterised in that the octave key button is so connected with an additional key, which is laterally disposed and indeed preferably on the left hand side of the body between the G- and A-buttons, via a shaft which extends in the longitudinal direction and which preferably passes through a hollow shaft for the actuation of the lower octave key by means of a lever which is rotationally fixed thereto, and via a lever which branches off from the shaft preferably at right angles thereto, that when the octave key button is depressed and the H-button is not depressed the additional key, which is biased into the opening direction, is released but is closed when the octave key button is not depressed or the H-key is depressed. The additional key provided in accordance with this embodiment makes it possible to play the high C and also C-sharp, D, D-sharp by releasing the H-button, then the A-button and furthermore by depressing the D- and D-sharp buttons with the octave button depressed. In this embodiment it is preferably arranged that the additional key is acted on by the lever arm of a second rocker lever the other arm of which is so connected to a lever which branches off from the H-button that when the H-button is depressed the additional key is necessarily closed against the opening spring force. A particularly simple compact construction is obtained if the second rocker lever is pivotally connected to end bearings secured to the body by means of a transverse shaft which is arranged at the left hand side of the body at right angles to the longitudinal axis and tangential to the body.

Another further development is characterised in that a first auxiliary key which is biased by spring force into the open position is provided at the level of the F-key on the side of the body, preferably at the left hand side, and can be pivoted via a third rocker lever about a shaft which extends transverse to the longitudinal direction of the body and tangential to the body, wherein the lever arm remote from the first auxiliary key is engaged from underneath by a lever which is rotatedly fixedly connected with the G-ring button so that, when the G-ring button is depressed, the first auxiliary key is depressed into the closed position. The tones which lie above G are stabilised by the opened auxiliary key. This results in substantially better intonation.

In order to save one button when compared with the saxophone fingering system, without impairing the easy way in which the instrument can be played, there is provided a further embodiment in which a combined G-sharp-D-sharp button is arranged beneath the G-button at the side in the area of the little finger of the left hand and so acts via a lever on the G-sharp key, which is resiliently biased into the opening direction, that the latter is released when the G-sharp-C-sharp button is depressed and the F-button is open but is otherwise closed, and so acts via a shaft and a lever on the C-sharp key, which is biased into the closing direction, that the latter is opened against spring force when the G-sharp-C-sharp button is depressed, with the C-button which acts on the C-key also so acting on the C-sharp key via a shaft and a lever that the C-sharp key is opened against the closing force when the C-key is open but is however closed when the C-button is depressed. The tone hole C-sharp is thus continually used as a sound-improving opening, which is provided because of the C-lever which is raised in the passive state. If however C is to played the C-sharp opening also closes together with the C-key. The C-sharp key closes as a result of its own spring force.

If the C-sharp should be played then it is only necessary to depress the G-sharp-C-sharp key with the left hand small finger whereby the C-sharp key is again opened. In other words the C-sharp key which is closed by a spring can be opened either by the open C-lever or by the depressed G-sharp-C-sharp lever.

The flute in accordance with the invention can finally also be developed further so that the D-ring button is connected with a second auxiliary key which lies at the same level as the D-sharp key, which is biased into the closing direction and is acted on by the D-sharp button, and is synchronously opened and closed with the D-tone hole. The opened D-sharp key only influences the fullness of the sound, not however the pitch of the note because the oscillating air column is shortened by the opening of the D-tone hole. Without the second auxiliary key the D-sharp key would otherwise have to be continually depressed in order to achieve the same fullness of sound. Accordingly, a good sound quality can be obtained considerably more simply as a result of the above named embodiment.

The flute of the invention can also be further developed in that between the F-key and the E-tone hole a further auxiliary key biased by spring force into the open position is pivotably arranged at the side of the flute, and indeed preferably on the right hand side, on a fourth rocker lever about a shaft which extends at right angles to the longitudinal direction of the body and tangential thereto, with the lever arm remote from the further auxiliary key being engaged from below by a lever which is rotatably fixedly connected with a longitudinal shaft which in turn is rotationally connected with the F-button. This ensures that the high and low F-sharp sound better and can be better intonated. In other words the purity of pitch of the flute of the invention is also improved in this way.

It is also useful for the improvement of the sound quality and of the purity of pitch if the E-button, which is located at the level of the index finger of the right hand, additionally closes the F-sharp key in such a way that when the E-button is depressed the F-sharp key is also closed.

Furthermore, it is expedient if the key and button mechanism consists of German silver.

The flute of the invention can be made, analogously to a recorder, in various sizes and registers, for example in the manner of a C-soprano recorder, of an F-alto recorder, of a C-tenor recorder, or also of the F-base recorder. Furthermore, the registers can be based in E-flat or B.

Figure 2:
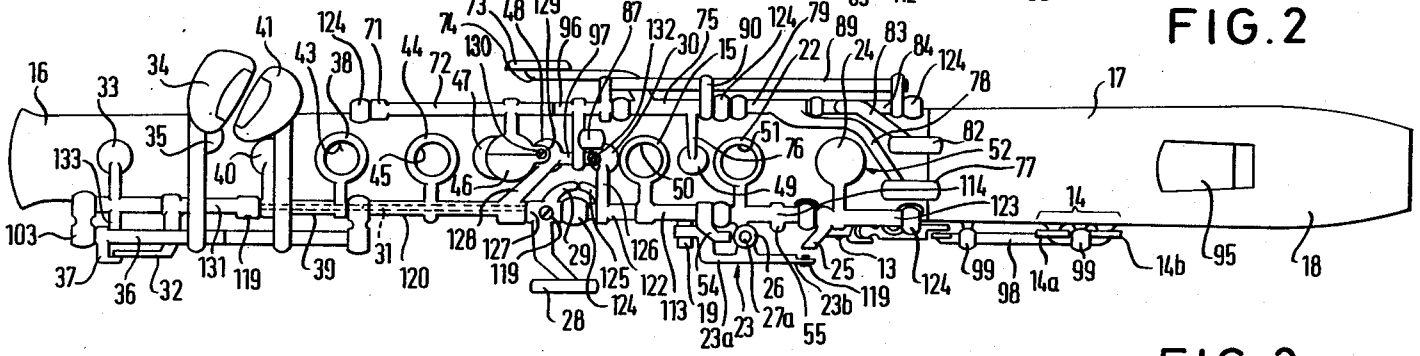
Figure 3:
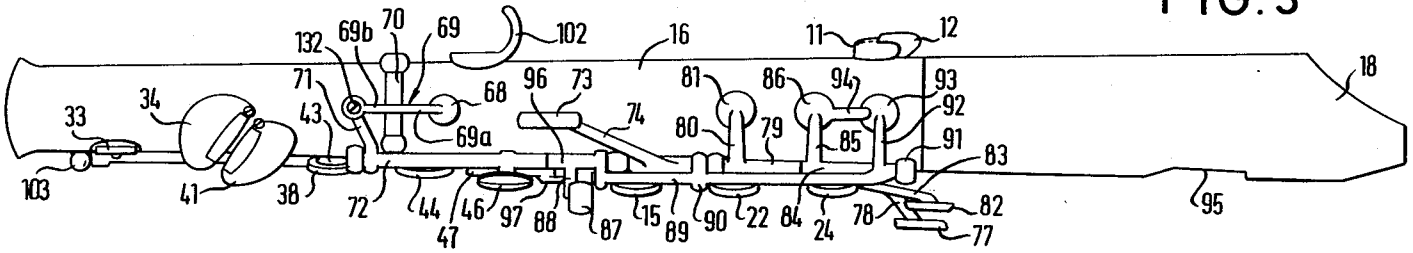
Figure 4:
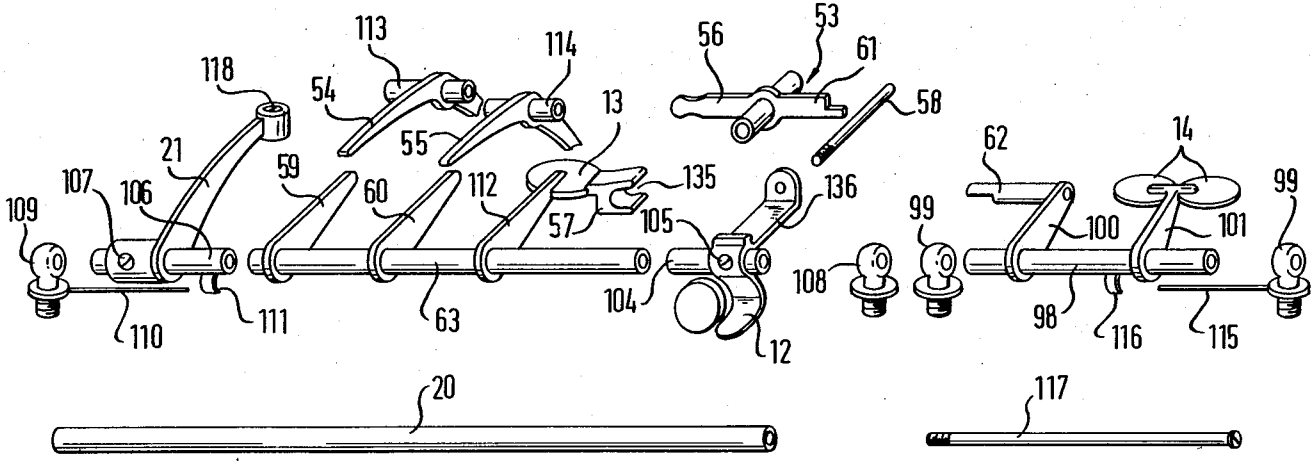

The invention will be described in the following by way of example and with reference to the drawings which show:

FIG. 1 a side view of the flute of the invention as seen from the left,

FIG. 2 a plan view on the upper or front side of the flute of the invention, FIG. 3 a side view of the flute of the invention as seen from right, and FIG. 4 a perspective illustration of the octave key system of the flute of the invention in an exploded view for the purpose of illustration.

As seen in FIGS. 1 to 3 the flute of the invention has a tubular body 16 which is open at both end faces. A throat 17 with a mouthpiece 18 is plugged onto the top end of the body 16. The body 16 and the throat 17 with the mouthpiece 18 are shaped and dimensioned in accordance with a type of recorder. For sound generation the mouthpiece 18 has a labium 95 typical for a recorder.

The body 16 has, starting from the bottom and moving upwardly, on the front or upper side, a C-button 34, a D-sharp button 41, a D-button 38, an E-button 44, an F-button 46, a G-button 15, an A-button 22 and an H-button 24. On the rear or lower side the body 16 has an octave key button 12. These buttons which can be actuated by the small finger, by the ring finger, by the middle finger, by the index finger of the right hand and also by the ring finger, the middle finger, the index finger and thumb of the left hand are spatially arranged as for a saxophone. The buttons which have been mentioned are rotatably journalled by means of pivot shafts 36, 39, 120, 72, 113, 114, 123 and 20 in bearing blocks 103, 124 secured to the body 16. A thumb support 102 arranged on the rear side of the instrument in the region of the F-button 46 serves for engagement of the right thumb and facilitates the holding of the instrument, similar to the situation with a saxophone.

The D-button 38, the E-button 44, the G-button 15 and the A-button 22 are ring buttons which surround a D-tone hole 43, an E-tone hole 45, a G-tone hole 50 and an A-tone hole 51 respectively in such a way that on depressing the respective ring button the tip of the finger is able to close the relevant tone hole.

The F-button 46 and the H-button 24 however form a constructional unit with an F-key 47 and an H-key 52 respectively so that on depressing one of the F-key or H-button it is not the tip of the finger but instead the associated key 47 or 52 respectively which closes the tone hole present beneath the key or cap which is not shown in the drawing.

All the above named buttons 34, 41, 38, 44, 46, 15, 22, 24 are biased by spring force into the open position. The springs have not been shown for the sake of simplicity.

The octave key 12 surrounds in half moon-like manner a support projection 11 on the rear side of the body 16 for the left thumb.

The octave key button 12 acts via a first rocker lever 53 on two octave keys 13, 14 which are arranged spaced apart one above the other of which the octave key button 12 is arranged on the left hand side of the body 16 and the upper octave key 14, which is constructed as a double key, is arranged on the left hand side of the throat 17. The throat 17 forms one piece with the mouthpiece 18.

The mechanism of the octave key will now be described in detail with reference also to FIG. 4.

The octave key button 12 is rotatably fixedly connected with a shaft 20 which is inserted into a sleeve 104 which forms a constructional unit with the button 12 and is clamped fast in an adjusted manner by means of a clamping screw 105. The shaft 20 extends through a hollow shaft 63 which itself extends in the longitudinal direction, up to a lever 21 which branches off from a rotatable sleeve 106. The other end of the shaft 20 is plugged into this rotatable sleeve 106 and can be rotatable fixedly connected with the lever 21 in a rotatably adjusted manner by means of a clamping screw 107. The shaft 20 is rotatably journalled at its ends in bearing blocks 108, 109. A steel needle spring 110 secured to the bearing block 109 engages under a nose 111 of the sleeve 106 whereby the octave key button 12 is biased away from the body 16 in the direction towards the player's thumb. The hollow shaft 63 sits in a freely rotatable manner on the shaft 20 which passes therethrough and is not biased by any form of spring.

The first rocker lever 53 is rotatably journalled by means of a transverse pivot axle 58 to a substantially right angled projection 136 of the octave key button 12, and indeed about an axle which extends at right angles to the longitudinal direction of the body 16 and tangentially to its left side.

The one arm 56 of the first rocker lever 53 engages in a recess 135 of a projection 57 on the lower octave key 13. The octave key 13 is fixedly connected with the hollow shaft 63 via a lever 112. Further levers 59, 60 likewise branch off at right angles from the hollow shaft 63 and engage beneath the G- and A-octave levers 54, 55 respectively which are in turn respectively rotatably connected to the pivot shaft 113 of the G-button 15 and to the pivot shaft 114 of the A-button. The levers 54, 55 extend approximately at a right angle to the G-button 15 and to the A-button 22.

The upper lever arm 61 of the first rocker lever 53 engages beneath a projection 62 on a lever 100 which branches off at right angles from a shaft 98 for the two upper octave keys 14 which extends in the longitudinal direction. The octave keys 14 are rotatably fixedly arranged on the shaft 98 by means of a lever 101.

The shaft 98 is rotatably journalled in end bearings 99. A steel needle spring 115 secured to the upper bearing block 99 engages beneath a nose 116 on the shaft 98 and in this way biases the double key 14 in the closing direction.

The shaft 98 is of hollow construction in just the same way as the bearing blocks 98 so that a bearing rod 117 can be passed therethrough for the rotational mounting of the shaft 98 and can be secured between the bearing blocks 99 by means of a threaded arrangement.

The octave key button 12 presses, as a result of the action of the spring 110, the right hand end of the first rocker lever 53 as seen in FIG. 4 onto the body 16 and the left hand end onto the octave key 13 via the recess 135. The upper octave double key 14 rests as a result of the pressure of spring 115 in the closed position with the connecting projection 62 standing closely over the right hand lever arm of the first rocker lever 53. The two octave keys 13, 14 thus remain closed in the lower octave, i.e. when the octave key button 12 is not depressed.

The tones of the next octave are now obtained by pressing the octave key button 12. All fingers may now bring the associated buttons into the closed position whereby the G- and the A-octave levers are raised and thus freed from the levers 59, 60, i.e. unload them. The octave key 13 now springs up because the rocker lever 53 remains depressed at its right end as seen in FIG. 4 through the force of the spring 115. The pressure of the octave key button 12 acts via the rocker lever 15 on the octave key 13 because this key floates without the spring pressure, whereas the double key 14 exerts a pressure on the rocker lever 53 through its spring force.

For the following tones up to G (ring finger left) nothing changes. If the ring finger or middle finger left is now lifted the rocker levers 54, 55 individually or jointly depress the octave key 13 into the closed position because, in accordance with the invention, the spring force of the G- or A-buttons 15 or 22 is stronger than the spring force which originates from the spring 115 of the octave key 14. The rocker lever 53 thus overcomes the force of the weaker spring 115 so that the keys 14 open.

As seen in FIGS. 1 and 2 the lever 21 which is attached to the sleeve 106 which is pivotable via the octave key button 12 (see also FIG. 4) extends to an additional key 19 arranged laterally on the left side of the body 16 between the G-button 15 and the A-button 22. The lever 21 engages over the additional key 19 (hereinafter also referred to as fourth auxiliary key) and is provided at its end with a adjustment screw 118 by means of which the desired spacing between the lever 21 and the additional key 19 can be produced.

As seen in FIGS. 1 and 2 the additional key 19 is secured to the lever arm 23*a* of a rocker lever 23, the other lever arm 23*b* of which engages over a lever 25 which branches off from the pivot shaft 123 of the H-button 24 at an angle of approximately 90°, in such a way that when the H-button is depressed the additional key 19 is necessarily closed against the spring opening force. The rocker lever 23 is pivotally journalled by means of a transverse shaft 26 which is arranged at the left side of the body 16 at right angles to the longitudinal axis and tangential to the body 16. The transverse shaft 26 is rotatably journalled in bearing blocks 27*a*, 27*b* by means of a pin which passes through the transverse shaft. The octave key button 12 is thus connected with the additional key 19 in such a way that when the octave key button 12 is depressed and the H-button 24 is not depressed the auxiliary key 19 which is resiliently biased into the opening direction is released, but is closed when the octave key button 12 is not depressed or when the H-button 24 is depressed. An adjustment screw 119 is located at the upper end of the lever arm 23*b*.

As seen in FIG. 1 an auxiliary key 64 (hereinafter also referred to as third auxilary key) which is biased by spring force into the open position is provided at the level of the F-key 47 laterally of the body 16 on the left side and is pivotable via a rocker lever 66 about a shaft 65 which extends transversely to the longitudinal direction of the body 16 and tangential to the body 16. The lever arm 66*b* of the rocker lever 66 remote from the auxiliary key 64 is engaged from below by a lever 67 which is rotatably fixedly connected to the G-button 15 so that when the G-button is depressed the auxiliary key 64 is pressed into the closed position. In this way the tones which lie above G are stabilised as a result of the opening of the auxiliary key 64.

A combined G-sharp-C-sharp button 28 which is more strongly spring-biased in the open direction is arranged at the side in the region of the little finger of the left hand. The combined G-sharp-C-sharp button 28 so acts, via its pivot shaft 127 and a lever 29 which engages beneath an extension 125 of the retaining lever 126 of the G-sharp key 30, on the G-sharp key 30 which is more weakly spring-biased in the opening direction, that the latter is released when the G-sharp-C-sharp button is depressed and the F-button 46 is open, but is otherwise held closed. The pivot shaft 127 is hollow and rotatably fixedly accommodates a shaft 31 which extends through hollow shafts 39, 120 to a pivot shaft 131. A lever 32 branches off from the pivot shaft 131. The lever 32 engages over a lever arm 133 which extends from a pivot shaft 121 in the opposite direction to the C-sharp key 33 which is arranged beneath the C-key 35 and is spring-biased into the closing direction. The lever 32 acts on the C-sharp key 33 so that it is opened against the spring force when the G-sharp-C-sharp button 28 is depressed. Moreover, the C-button 34 which is connected with the C-key 35 so acts on the C-sharp key 33, via a shaft 36 and a lever 37 which engages over the lever arm 133 that the C-sharp key 33 is opened against the closing spring force when the C-key 35 is opened by acorrespondingly stronger spring but is however closed when the C-button 34 is depressed.

The D-button 38 is connected with an auxiliary key 40 (hereinafter also referred to as a first auxiliary key) which lies at the same level as the D-sharp key 42 which is biased into the closing direction and is acted on by the D-sharp button 41, and is synchronously opened and closed with the D-key 43.

The D-sharp key 42 is located on the left side of the body 16, the auxiliary key 40 is located on its front side. The rotatably fixed connection between the D-key 38 and the auxiliary key 40 is produced by a hollow shaft 39 which extends in the longitudinal direction of the body 16. The shaft 31 which extends between the G-sharp-C-sharp button 28 and the lever 32 is guided in part through this hollow shaft 39 and a further hollow shaft 120 which pivotably carries the E-button 44.

A further auxiliary key 68 (hereinafter also referred to as a second auxilary key) which is biased by spring force into the open position is disposed between the F-key 47 and the E-tone hole 45 laterally at the right hand side and is arranged on a rocker lever 69 for pivotal movement about a shaft 70 which extends at right angles to the longitudinal axis of the body 16 and tangential thereto. The lever arm 69*b* remote from the auxiliary key 68 is engaged from below by a lever 71 which is rotatably fixedly connected with a longitudinal shaft 72 which is in turn rotatably connected with the F-button 46.

The E-button 87 which is located at the level of the right hand index finger also closes the F-sharp key 48 which is arranged above the F-button 46 and covers over a tone hole which is not illustrated, in such a way that when the E-button 87 is depressed the F-key 48 is closed. For this purpose a lever 88 of the high-E-button 87 engages over an extension 97 of the F-sharp key 48. The F-sharp key 48 is furthermore rotationally fixedly connected via a lever 128 with the pivot shaft 120 of the E-button 44. An extension 129 of the F-button 46 in turn engages over the F-sharp key 48.

The formation 97 not only serves to close the F-sharp key 46 via the E-button 44.

The formation 97 also engages over the G-sharp key 30 and thus always presses the G-sharp key 30 into the closed position when the E-button 44 and/or the F-button 46 is/are depressed. The formation 97 thus satisfies two functions. The high E-button 87 is further connected via the lever 88, a pivot shaft 96, a connection rod 89 with intermediate rotational mounting 90, and a lever 92 journalled in a bearing 91, with the high E-key 93 arranged right of the top on the body 16 (FIG. 3).

The B-tone hole which is covered over by the B-key 49 is arranged between the G-tone hole 50 and the A-tone hole 51. The B-key 49 is connected via a lever 76, a rotary shaft 75 extending in the longitudinal direction and an actuating lever 74 with the B-button 73 which is arranged on the right side of the body 16 approximately at the level of the G-sharp-C-sharp button 28.

The high D-button 77 which is actuated with the left index finger is located above and somewhat to the side of the H-button 24. It is connected via a D-lever 78, a shaft 79 and a lever 80 which extends at right angles thereto with the high D-key 81 which is disposed laterally of the body 16 at the level of the A-tone hole 51.

The high E-minor button 82 which can be actuated with the left index finger lies on the right alongside the high D-button 77 and is connected via an E-minor lever 83, a longitudinal shaft 84 and a transverse lever 85 with the high E-minor key 86 which is arranged on the right side of the body 16 above the high D-key. A formation 94 extends from the high E-minor key 86 over the high E-key 93 so that when the E-button 87 is depressed the E-minor key 86 opens up with it.

The hollow pivot shafts 121 of the C-sharp key 33; 131, 31 and 127 of the C-sharp-G-sharp button 28; 39 of the D-sharp button 38; 120 of the E-button 44; 122 of the G-sharp key 30; 113 of the G-button 15; 114 of the A-button 22 and 123 of the H-button 24 are rotatably journalled coaxial to one another and extending the longitudinal direction on the left at the front side of the body 16 in bearing blocks 124 by means of shafts of solid material (for example 31) which pass through them.

A tone hole in the body 16 or in the throat 17, which is not illustrated, is associated with each of the keys and is covered over thereby, even if this is not expressly mentioned.

The various hollow shafts which are arranged on pins or massive shafts are fixedly clamped, so far as necessary, by adjustment screws 119. Adjustment screws 130 and 132 are also located on the extension 129 and also at the ends of the formation 97 and of the lever arm **66*b*, 69*b***.

So far as the arrangement of specific keys, levers, shafts and bearing blocks has not been described here in detail the arrangement is the same as with a saxophone fingering system.

The spatial association and arrangement of individual buttons, keys, tone holes, shafts, levers and other components which can be seen in the drawing are significant features of the invention even if this is not been described above in detail.

As a result of the described arrangement it is possible to substantially use the saxophone fingering system with a flute and nevertheless to have excellent rendering of each sound including the higher tones and the semitones.

The ring buttons "D" 38, 44, 15, 22 can optionally be replaced by full caps (key caps with heads or cushions).

The various notes which can be played with the flute of the invention can be generated by depressing the following buttons:

low C: depressing the C-button 34, the D-button 38, the E-button 44, the F-button 46, the G-button 15, the A-button 22 and the H-button 24;

low C-sharp: as for low C, however additionally depressing the C-sharp-G-sharp button 28;

low D: depressing he D-button 38, the E-button 44, the F-button 46, the G-button 15, the A-button 22 and the H-button 24;

low D-sharp: as low D but additionally depressing the D-sharp button 41.

low E: depressing the E-button 44, the F-button 46, the G-button 15, the A-button 22 and the H-button 24.

low F: depressing the F-button 46, the G-button 15, the A-button 22 and the H-button 24.

low F-sharp: depressing the E-button 44, the G-button 15, the A-button 22 and the H-button 24.

low G: depressing the G-button 15, the A-button 22 and the H-button 24.

low G-sharp: as for low G additionally depressing the G-sharp-C-sharp button 28.

low A: depressing the A-button 22 and the H-button 24.

low $B^b$:

1. as for low A additionally depressing the $B^b$-button 73.
2. depressing the F-button 46, the G-button 15 and the H-button 24.

low H: depressing H-button 24.

middle C: depressing the A-button 22.

middle C-sharp:

1. depressing no buttons.
2. as for low C-sharp but additionally using the octave button 12.

middle D: as for low D additionally depressing the octave button 12 middle D-sharp: as for low D-sharp additionally depressing the octave button 12 middle E: as for low E additionally depressing the octave button 12 middle F: as for low F additionally depressing the octave button 12 middle F-sharp: as for low F-sharp additionally depressing the octave button 12 middle G: as for low G additionally depressing the octave button 12 middle G-sharp: as for low G-sharp additionally depressing the octave button 12 middle A: as for low A additionally depressing the octave button 12 middle $B^b$:

1. as for low $B^b$ additionally depressing the octave button 12
2. depressing the F-button 46 and the H-button 24 middle H: as for low H additionally depressing the octave button 12 high C:

1. as for middle C additionally depressing the octave button 12
2. depressing the H-button 24, the F-button 46, the E-button 44, the D-button 38, the D-sharp button 41.

high C-sharp:

1. as middle C-sharp additionally depressing the octave key 12
2. depressing the G-button 15, the F-button 46, the E-button 44 and the octave button 12.

high D:

1. depressing the high D-button 77 and octave button 12
2. depressing the G-button 15, the E-button 44 and the octave button 12 high D-sharp:

1. depressing the high D-button 77, the high D-sharp button 82 and the octave button 12
2. depressing the G-button 15 and the octave button 12
3. as under 2, additionally depressing the C-button 34 high E:

1. depressing the high E-button 87 and
2. as under 1. additionally the high D-button 77 and the high D-sharp button 82.

high F:

1. depressing the high E-button 87, the D-button 38, the A-button 22 and the octave button 12
2. depressing the high D-button 77, the high D-sharp button 82, the high E-button 87 and the D-button 38, octave button 12
3. depressing the high E-button 87 and D-button 38.

The invention thus provides a flute with the mouthpiece, the form and the dimensions of a recorder which is however provided with a key mechanism similar to that of the saxophone with the buttons, keys and tone holes however being adapted to the special features of sound generation of a recorder.

The advantages are summarised as follows:

easily playable chromatic fingering system (similar to the saxophone, but specially adapted however to the requirements of a recorder);

easy rendering in the entire range of sound as a result of the novel octave key system;

clean intonation in the entire range of sound as a result of automatic key combinations;

it opens for the recorder for the first time an unlimited scope of use for all music directions and degrees of difficulty;

saxophonists are immediately able to play this flute. Vice versa, someone who has learnt on this flute can at once be transferred to a saxophone.

I claim:

1. A flute having a body and a mouthpiece on the body, wherein tone holes are closable by keys actuated via button-operated levers, characterized in that there are provided one after the other starting from an end remote from the mouthpiece (18) and moving toward the mouthpiece, on an upper side thereof, a C-button (34), a D-sharp button (41), a D-button (38), an E-button (44), and F-button (46), on the right side thereof, a B-button (73), again on the upper side a G-button (15), an A-button (22) and an H-button (24), a B-button located between said F-button (46) and said G-button (15), a C-sharp-G-sharp-button (28) located between said F-button (46) and said G-button (15), and, on a lower side thereof, an octave key button (12), and also keys connected to the buttons and tone holes associated with the buttons;

(a) the C-button (34) which acts on a C-key (35) also acting on a C-sharp key (33) via a shaft (36) and a lever (37) such that the C-sharp key is opened against a closing spring force when the C-key (35) is open but is closed when the C-button (34) is depressed;

(b) the D-button (38) is connected with a first auxiliary key (40) which lies at the same level as a D-sharp Key (42), which is biased into the closing direction and is acted on by the D-sharp button (41), and is synchronously opened and closed with a D-tone hole (43);

(c) between an F-key (47) and an E-tone (45) a second auxiliary key (68) biased by spring force into the open position and opening and closing together with the F-button (47) is pivotally arranged at the side of the body;

(d) third auxiliary key (64) which is biased by spring force into the open position is provided at the level of the F-key (47) on the side of the body (16) and is depressed into the closed position when the G-button (15) is depressed;

(e) a B-key (49) is always closed unless the B-button (73) is depressed whereby the B-key (49) is opened.

2. A flute in accordance with claim 1, characterized in that a fourth auxiliary key (19) which is biased into the opening direction is arranged at one side of the body (16) between the G- and the A-buttons (15, 22) said additional key (19) being released when the octave key button (12) is depressed and the H-button (24) is not depressed, but being closed when the octave key button (12) is not depressed or the H-key (24) is depressed.

3. A flute in accordance with claim 2, characterized in that the fourth auxiliary key (19) is provided at the left side of the body (16).

4. A flute in accordance with claim 1, characterized in that the combined G-sharp-C-sharp button (28) is arranged beneath the G-button (15) at the side in the area of the left hand little finger and so acts via a lever (29) on a G-sharp key (30), which is released when the G-sharp-C-sharp button (28) is depressed and the F-button (46) is open but is otherwise closed, and so acts via a shaft (31) and a lever (32) on the C-sharp key (33), which is biased into the closing direction, but the latter is opened against spring force when the G-shapr-C-sharp button (28) is depressed.

5. A flute in accordance with claim 1, characterized in that the second auxiliary key (68) is arranged between the F-key (47) and the E-tone hole (45) is connected to a rocker lever (69) being supported by a shaft which extends at right angles to the longitudinal direction of the body (16) and tengential thereto, with a lever arm (**69*b*) remote from the second auxiliary key (68) being engaged from below by a lever (71) which is rotatably fixedly connected with a longitudinal shaft (72) which in turn is rotationally connected with the F-button (46**).

6. A flute in accordance with claim 1 characterized in the third auxiliary key (64) is provided at the left hand side of the body and is pivotable via a rocker lever (66) about a shaft (65) which extends transverse to the longitudinal direction of the body (16) and tangential to the body (16), wherein the lever arm (**66*b*) remote from the third auxiliary key (64) is engaged from underneath by a lever (67) which is rotatedly fixedly connected with the G-button (15**).

7. A flute in accordance with claim 1, characterized in that the body (16) is elongate and preferably straight of tubular shape, and there is a preferably straight throat (17) in one piece with the mouthpiece (18) which can be plugged together with the straight body (16).

8. A flute in accordance with claim 1, characterized in that the octave key button (12) is arranged directly above a support projection (11) provided for the left thumb on a lower side of the flute, with the octave key button (12) acting via a first rocket lever (53) on two octave keys (13, 14) which are arranged spaced apart from one another and which are simultaneously so connected via a G-octave key lever (54) with the G-button (15) that when the octave key button (12) and the G-button (15) are depressed only one of the octave keys (13) arranged lower on the body (16) is int he open position and that if the G-button (15) is not depressed only the other octave key (14) is in the open position.

9. A flute in accordance with claim 8, characterized in that the A-button (22) is also connected with the two octave keys (13, 14) via a corresponding A-octave lever (55) in such a way that when the G-button (15) is depressed, but not the A-button (22), the one octave key (13) on tye body (16) is closed but the other octave key (14) is open.

10. A flute in accordance with claim 8, characterized in that the other octave key (14) consists of two individual caps (14*a*, 14*b*) which each cooperate with a respective hole in a throat (17) and which are arranged a small distance above one another and jointly actuated.

11. A flute in accordance with claim 8, characterized in that the octave key-button (12) is connected with the fourth auxiliary key (19) via a shaft (20) which extends in the longitudinal direction and which preferably passes through a hollow shaft (63) for the actuation of the one octave key (13) by means of a lever (59, 60) which is rotationally fixedly connected thereto, and via a lever (21) which branches off from the shaft (20) at right angles thereto.

12. A flute in accordance with claim 11, characterized in that the fourth auxiliary key (19) is acted on by a lever arm (23*a*) of a second rocket lever (23) another lever arm (23*b*) of which is so connected to a lever (25) which branches off from the H-button (24) that when the H-button is depressed the additional key (19) is closed against the opening spring force.

13. A flute in accordance with claim 12, characterized in that the second rocker lever (23) is pivotally connected to an end bearing (27*a*, 27*b*) secured to the body (16) by means of a transverse shaft (26) which is arranged at a left hand side of the body at right angles to the longitudinal axis and tangential to the body (16).

14. A flute in accordance with claim 1, characterized in that a high E-button (87) located at the level of the right hand index finger, additionally closes an F-sharp key (48) in such a way that when the the high E-button (87) is depressed the F-sharp key (48) is also closed.

* * * * *